US010386027B1

(12) United States Patent
Lax et al.

(10) Patent No.: US 10,386,027 B1
(45) Date of Patent: Aug. 20, 2019

(54) PATHWAY LIGHTING SYSTEM FOR TUNNELS

(71) Applicant: Clear-Vu Lighting LLC

(72) Inventors: Daniel A. Lax, Roslyn, NY (US); Agjah I. Libohova, East Setauket, NY (US); Timothy J. Keuning, Northport, NY (US); Roy Jacob, Wantagh, NY (US); Michael Lax, Laurel Hollow, NY (US)

(73) Assignee: CLEAR-VU LIGHTING LLC, Central Islip, NY (US)

( * ) Notice: Subject to any disclaimer, the term of this patent is extended or adjusted under 35 U.S.C. 154(b) by 201 days.

(21) Appl. No.: 14/486,899

(22) Filed: Sep. 15, 2014

Related U.S. Application Data

(60) Provisional application No. 61/877,779, filed on Sep. 13, 2013.

(51) Int. Cl.

| | |
|---|---|
| ***F21S 8/00*** | (2006.01) |
| ***F21V 33/00*** | (2006.01) |
| ***F21S 4/00*** | (2016.01) |
| ***F21S 9/02*** | (2006.01) |
| ***F21V 1/08*** | (2006.01) |
| ***F21V 21/02*** | (2006.01) |
| ***B61B 13/10*** | (2006.01) |
| *F21W 131/101* | (2006.01) |
| *F21Y 103/00* | (2016.01) |

(52) U.S. Cl.
CPC ..... *F21S 8/036* (2013.01); *B61B 13/10* (2013.01); *F21S 4/008* (2013.01); *F21S 9/02* (2013.01); *F21V 1/08* (2013.01); *F21V 21/02* (2013.01); *F21V 33/006* (2013.01); *F21W 2131/101* (2013.01); *F21Y 2103/003* (2013.01)

(58) Field of Classification Search
CPC .. F21V 1/08; F21V 21/02; F21V 15/04; F21S 8/036; F21S 8/033
USPC ..... 248/322, 220.21, 220.22, 304, 339, 306, 248/305, 690, 692
See application file for complete search history.

(56) References Cited

U.S. PATENT DOCUMENTS 2,527,216 A * 10/1950 Harris ..... B42D 5/006 248/225.21
2,673,286 A * 3/1954 Moore ..... F21S 8/081 362/278

(Continued)

FOREIGN PATENT DOCUMENTS

WO 2014134608 A2 9/2014

OTHER PUBLICATIONS

Philips Lumileds Press Information, Jan. 23, 2007.

(Continued)

*Primary Examiner* — Julie A Bannan
(74) *Attorney, Agent, or Firm* — Zollinger & Burleson Ltd.

(57) ABSTRACT

A light unit used in train tunnels is readily mountable and removable from a mounting bracket. The mounting bracket allows the battery backup system and light engine to be gravity mounted in manner that allows for quick and easy mounting and removal while also resisting vibrations and wind. A quick disconnect fitting can be used with the power cord to allow the units to be removed and replaced as needed. The light unit integrates the light engine with a battery backup system so that the entire light and battery unit is removed and replaced when necessary.

11 Claims, 9 Drawing Sheets

(56) References Cited

U.S. PATENT DOCUMENTS

| | | | | |
|---|---|---|---|---|
| 3,746,921 | A | 7/1973 | Marshall et al. | |
| 4,369,487 | A | 1/1983 | Carlow | |
| 5,608,375 | A | 3/1997 | Kosich | |
| 6,072,708 | A | 6/2000 | Fischer | |
| 6,283,621 | B1 | 9/2001 | Macri | |
| 6,739,734 | B1 | 5/2004 | Hulgan | |
| 7,086,747 | B2 | 8/2006 | Nielson et al. | |
| 7,140,742 | B2 | 11/2006 | Pohlert | |
| 7,229,185 | B1 | 6/2007 | Galvez | |
| 7,360,929 | B2 * | 4/2008 | Pfund | F21S 8/033 248/51 |
| 7,387,407 | B2 | 6/2008 | Tseng | |
| 7,470,036 | B2 | 12/2008 | Deighton et al. | |
| 7,663,898 | B2 | 2/2010 | Lindemann et al. | |
| 7,922,354 | B2 | 4/2011 | Everhart | |
| 7,926,982 | B2 | 4/2011 | Liu | |
| 8,018,161 | B2 | 9/2011 | Smith, III et al. | |
| 8,294,379 | B2 | 10/2012 | Liu et al. | |
| 8,299,712 | B2 | 10/2012 | Smith, III et al. | |
| 8,814,376 | B2 | 8/2014 | Nicolai et al. | |
| 9,425,649 | B2 | 8/2016 | Singer et al. | |
| 9,625,139 | B2 | 4/2017 | Lax et al. | |
| 9,672,700 | B2 | 6/2017 | Lax | |
| 9,909,748 | B2 | 3/2018 | Lax et al. | |
| 2002/0193955 | A1 * | 12/2002 | Bertness | G01R 31/3627 702/63 |
| 2004/0257789 | A1 | 12/2004 | Nielson et al. | |
| 2005/0018435 | A1 | 1/2005 | Selkee et al. | |
| 2005/0174755 | A1 | 8/2005 | Becker | |
| 2005/0190078 | A1 | 9/2005 | Salter | |
| 2005/0221659 | A1 | 10/2005 | Mrakovich et al. | |
| 2005/0254237 | A1 | 11/2005 | Nath et al. | |
| 2006/0215422 | A1 | 9/2006 | Laizure | |
| 2007/0064450 | A1 | 3/2007 | Chiba et al. | |
| 2007/0070622 | A1 | 3/2007 | Allen | |
| 2007/0189001 | A1 | 8/2007 | Nielson et al. | |
| 2007/0195527 | A1 | 8/2007 | Russell | |
| 2007/0222399 | A1 | 9/2007 | Bondy et al. | |
| 2007/0247842 | A1 * | 10/2007 | Zampini | F21S 2/00 362/227 |
| 2007/0274084 | A1 | 11/2007 | Kan et al. | |
| 2008/0080162 | A1 * | 4/2008 | Wilcox | F21S 8/086 362/20 |
| 2008/0212319 | A1 * | 9/2008 | Klipstein | B60Q 3/065 362/231 |
| 2010/0019690 | A1 | 1/2010 | Libohova et al. | |
| 2010/0148697 | A1 | 6/2010 | Bayat et al. | |
| 2010/0244721 | A1 | 9/2010 | Shloush et al. | |
| 2010/0296285 | A1 * | 11/2010 | Chemel | F21S 2/005 362/235 |
| 2010/0296536 | A1 | 11/2010 | Tao | |
| 2011/0058358 | A1 | 3/2011 | Soo et al. | |
| 2012/0007516 | A1 | 1/2012 | Lax | |
| 2012/0127702 | A1 | 5/2012 | Lax | |
| 2012/0168576 | A1 | 7/2012 | Intravtola | |
| 2013/0201658 | A1 | 8/2013 | Bogart et al. | |
| 2014/0320011 | A1 | 10/2014 | Hegarty | |
| 2015/0009666 | A1 | 1/2015 | Keng et al. | |
| 2016/0035192 | A1 | 2/2016 | Lax | |

OTHER PUBLICATIONS

ProTran 1, 120 VAC LED Safety Light, Sep. 12, 2008.
ProTran 1, 1000VDC LED Safety Light, Sep. 12, 2008.
ProTran 1, 1000VDC White LED Portable Lamp Bank for MOW, Dec. 20, 2008.
Lumascape, LED Product Catalogue 2008, Mar. 2008.
Clear-vu lighting Metroguide Pathlight, publication date unknown, document includes date of Sep. 25, 2013.

* cited by examiner

PATHWAY LIGHTING SYSTEM FOR TUNNELS

CROSS REFERENCE TO RELATED APPLICATIONS

This application claims the benefit of U.S. Provisional Patent Application Ser. No. 61/877,779 filed Sep. 13, 2013; the disclosures of which are incorporated herein by reference.

BACKGROUND OF THE DISCLOSURE

1. Technical Field

The present disclosure relates to lighting units and, more particularly, to light units and lighting systems used in tunnels.

2. Background Information

Underground train systems are numerous in various public and private applications. Despite the headlights on the trains themselves, the systems light the track tunnels with pathway lights disposed along the sides of the tunnels. The pathway lights shine down to light the track without shining laterally to avoid distracting the train's operator. The lights are supported by remote battery backup systems.

Existing subway tunnels in New York City are lighted with 20 Watt incandescent light bulbs spaced thirty feet apart and staggered on opposite sides of the tunnel such that light is cast down onto the track at fifteen foot intervals. The light bulbs are enclosed within solid shades that direct the light downwardly. Drawbacks with the existing lights are the power consumption, fixed configurations, and maintenance. These bulbs are replaced about once per year and their battery backup systems are remotely located. They are also electrically inefficient.

SUMMARY OF THE DISCLOSURE

The configurations of the light system and lights units described herein may be used in transportation systems and, in particular, within underground train tunnels. The lights also may be used in architectural applications wherein battery backed-up downwardly directed light is desired.

The disclosure provides a light unit wherein the light engine is integrated with the battery backup so that the entire light and battery unit may be removed and replaced when necessary. A mounting bracket is disclosed that allows the battery backup system and light engine to be gravity mounted in manner that allows for quick and easy mounting and removal while also resisting vibrations and wind. A quick disconnect fitting can be used with the power cord to allow the units to be removed and replaced as needed.

The disclosure provides a light unit having self test features. The self test system turns off the entire light when a fault in the battery backup is detected. The battery backup system is only active when the light unit is installed to allow the light unit to be stored with the batteries installed.

The disclosure provides a light unit wherein the light provided by the unit primarily shines downwardly and the unit housing includes removable lateral light shades that allow the unit to be selectively configured.

The disclosure provides a light unit wherein the battery backup system and light engine are compact such that they can be used on the walls of existing tunnels. In one configuration, the housing that contains the battery system and the light engine fits within a perimeter of 12×11.5×4.5 inches.

The disclosure provides a light unit having a handle that allows the unit or multiple units to be carried by one hand.

The disclosure provides a light unit wherein the light engine and battery housing are spaced from stainless steel mounting brackets by a spacer. The spacer can also function as a vibration damper.

The system provides uniform light across and along the tunnel floor when the light units are spaced apart by thirty feet on each side of the tunnel and staggered in the same configuration as existing lights. The lights meet or surpass a max to min ratio of seven.

BRIEF DESCRIPTION OF THE DRAWINGS

Similar numbers refer to similar parts throughout the specification.

DETAILED DESCRIPTION OF THE DISCLOSURE

Figure 2:
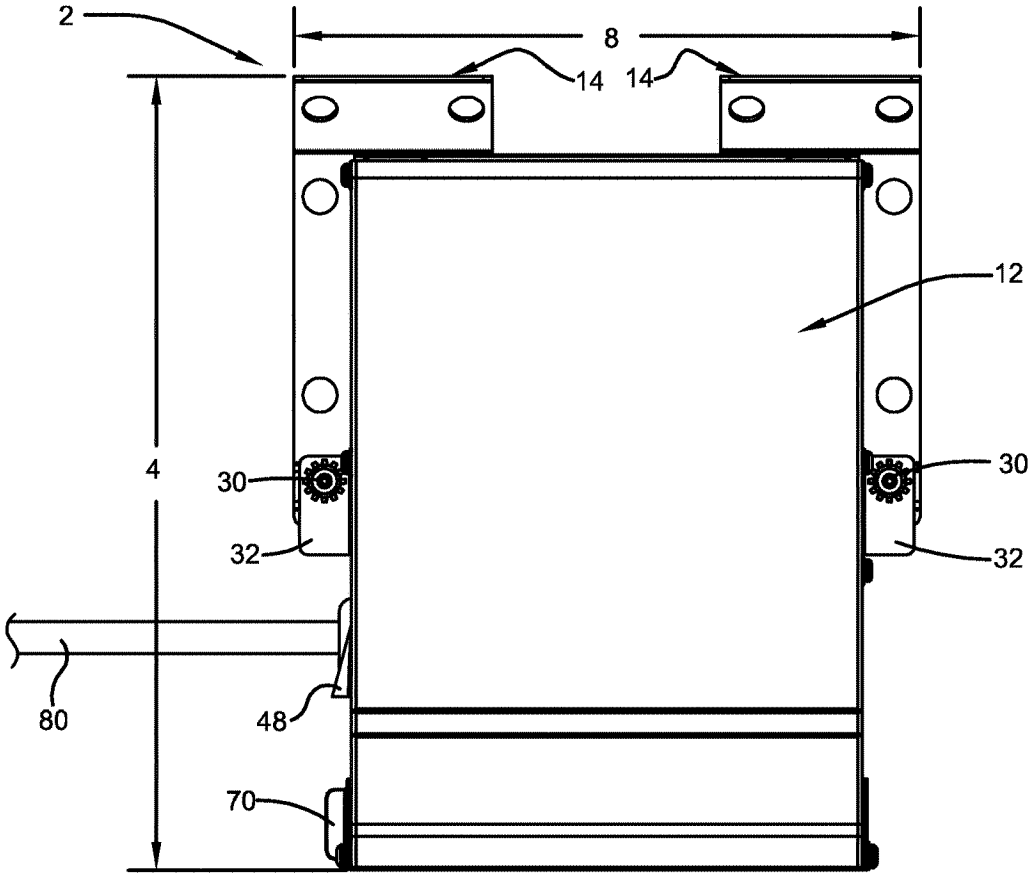
FIG. 2 is a front elevation view of FIG. 1.
Figure 3:
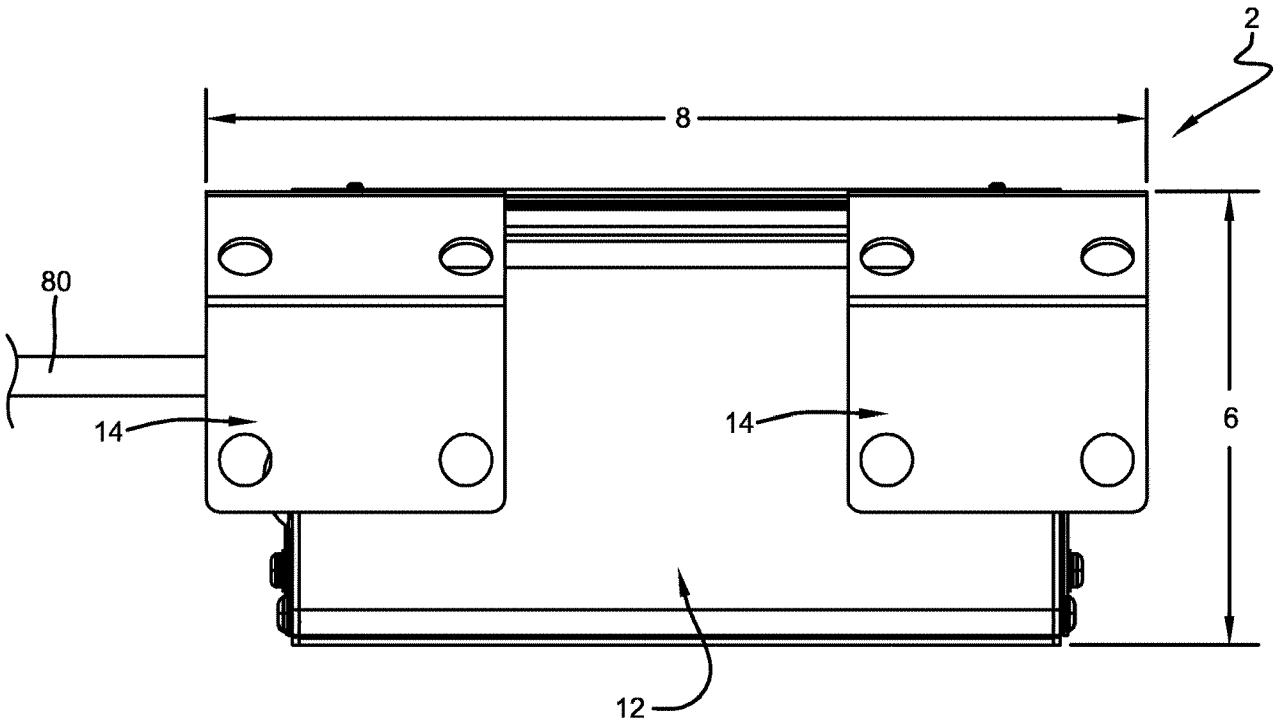
FIG. 3 is a top plan view of FIG. 1.

An exemplary configuration of a lighting system is indicated generally by the numeral 2 in the accompanying drawings. System 2 can be used in subway tunnels to light the track bed for the train operators and to provide light for maintenance workers. System 2 can also be used in other indoor or outdoor architectural applications where a battery backup system for the lighting is desired. System 2 fits within the depth of existing New York Subway tunnel light and bracket combinations to allow for retrofitting. In addition, system 2 substantially fits within the three dimensional perimeter of existing light units while including a battery backup system within the same perimeter which was not achieved by the existing light and bracket systems which use remote battery backup equipment. System 2 (not including the power supply cord) has an installed height (dimension line 4 in FIG. 2) of less than 11.5 inches, a depth (dimension line 6 in FIG. 3) of less than 4.5 inches, and a length (dimension line 8 in FIG. 3) of less than 12 inches (and less than 9.5 inches in one configuration). The 4.5 inch depth limitation and the 11.5 inch height limitation are more important to the retrofitting than the length dimension.

System 2 generally includes a light and battery unit disposed in a housing 12 that is selectively mountable to and removable from a bracket system. Bracket system includes at least one bracket 14 and may include a plurality of spaced brackets 14. A spacer 16 can be used to prevent housing 12 from contacting bracket 14. When used in subway tunnels, brackets 14 are directly connected to concrete walls with suitable anchors (concrete screws, nails, or other masonry connectors). Bracket 14 is made from stainless steel. In some configurations, housing 12 is made from aluminum. Direct contact between stainless steel and aluminum is undesirable especially in hot humid environments because of galvanic corrosion. In these conditions, spacer 16 prevents direct contact between the two metals while also providing a shock absorber to housing 12 against the repeated vibration forces to which system 2 is subjected.

Figure 4:
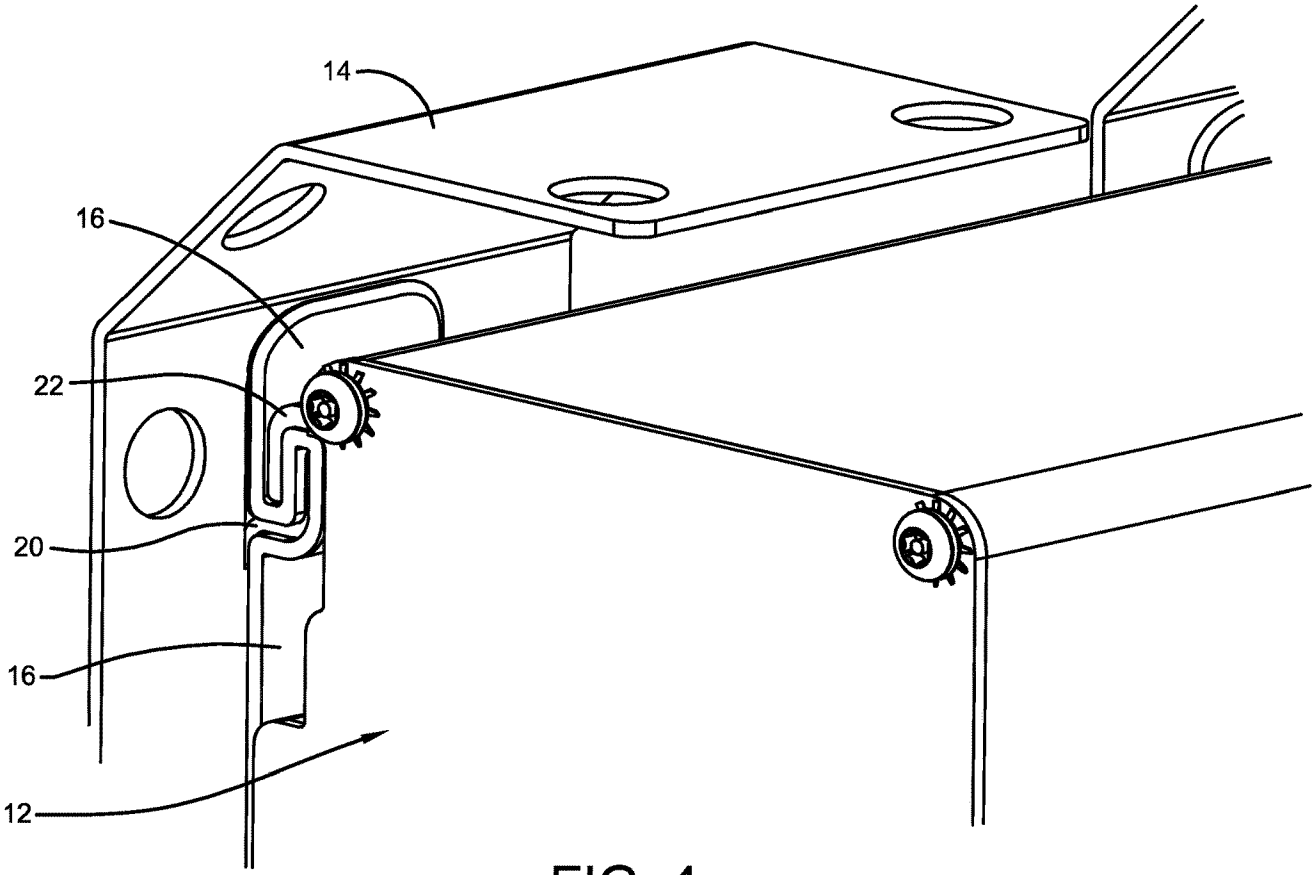
FIG. 4 is an enlarged perspective view showing the spacer disposed between the housing and bracket throughout the length of the mounting hooks.
Figure 5:
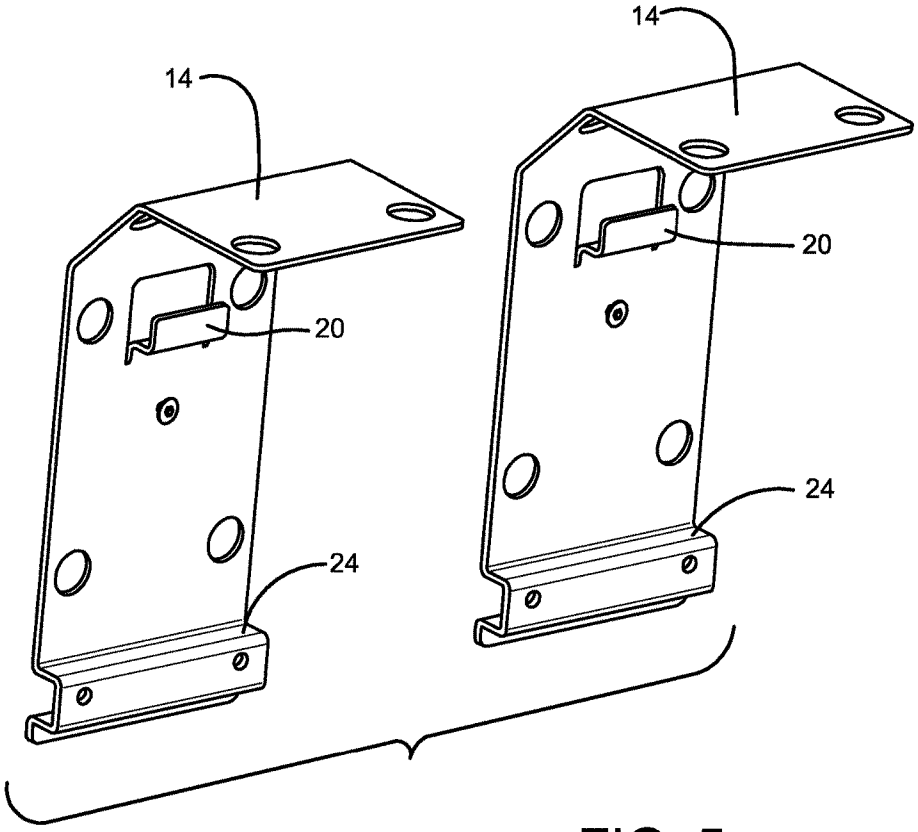
FIG. 5 is a perspective view of the mounting brackets.
Figure 6:
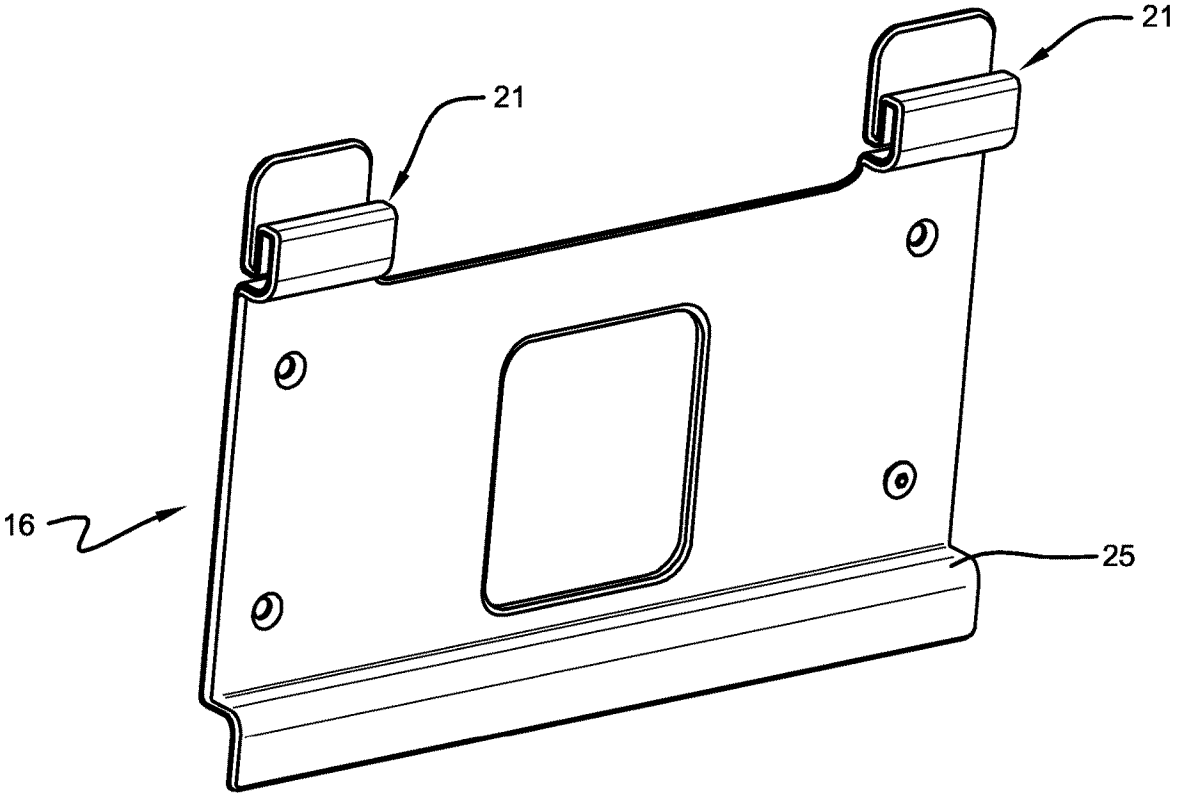
FIG. 6 is a perspective view of the spacer used between the housing and the brackets.

Spacer 16 is made from an insulating material such as a polymer, a rubber, fiberglass, PVC, coated aluminum, or other insulating material. Spacer 16 can be resilient to help secure housing 12 and to act as a shock absorber. Spacer 16 can be secured to brackets 14 with fasteners such as screws or rivets. Spacer 16 wraps closely around the hooks 20 of brackets 14 to maintain the separation of brackets 14 from housing 12 and to dampen vibrations. The hooks 22 of housing 12 slide into slots entirely lined by spacer 16 as shown in FIG. 4. The hook liners 21 of spacer 16 are shown in FIG. 6. Spacer 16 may be installed by sliding spacer 16 onto brackets 14 or by sliding brackets 14 onto spacer 16.

Each bracket 14 also defines a shelf 24 and spacer 16 covers shelf 24 with a shelf cover 25 so that a ledge 26 defined by housing 12 rests on shelf 24 such that housing 12 is supported without the need to manipulate fasteners before housing 12 is supported.

Figure 1:
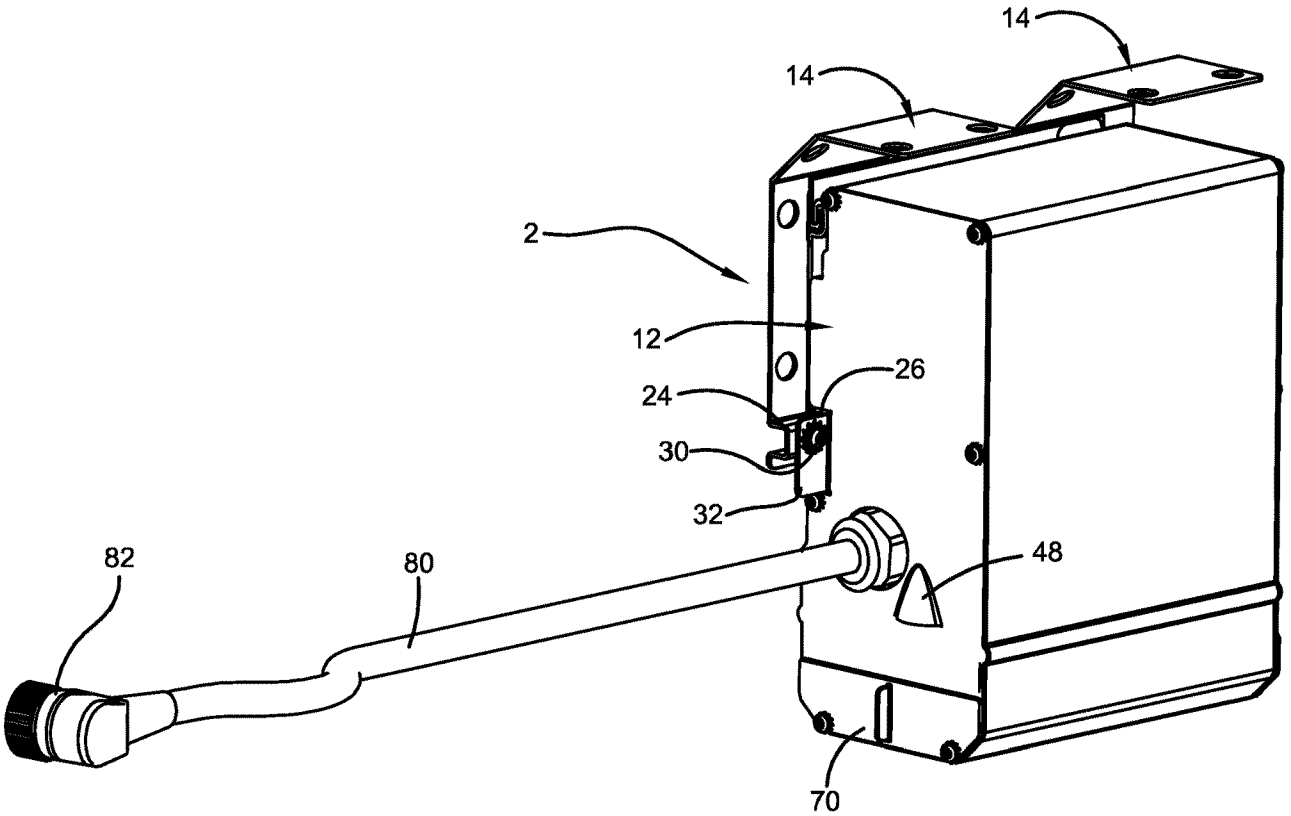
FIG. 1 is a front perspective view of a light unit mounted to a pair of mounting brackets with the spacer disposed between the housing the mounting brackets.

Lateral fasteners 30 can be installed through tabs 32 that extend from housing 12 to secure housing 12 to brackets 14. Tabs 32 are spaced from brackets 14 as shown in FIG. 1 to prevent direct contact. Spacer 16 can include ears that extend between tabs 32 and brackets 14 to prevent direct contact. Fasteners 30 limit lengthwise movement of housing 12 with respect to brackets 14 and spacer 16. These fasteners 30 can be installed after housing 12 is fully supported by hooks 20 and shelf 24.

System 2 thus makes it easy for a maintenance worker to remove a non-functioning light and battery unit 10 and replace it with a new unit 10. The quick mount system allows an old unit 10 can be removed from brackets 14 with one hand while a new unit 10 can be installed with the other hand. An optional handle 34 allows the person replacing units 10 to carry one or more units 10 with one hand. Handle 34 is movable between extended and storage positions. The storage position of handle 34 is within the perimeter dimensions described above. The extended position provides an opening for the insertion of the hand or fingers of the person carrying the light. Handle 34 also allows a plurality of lights to be hung on a carrier. The installation process is thus easy, can be accomplished by a single worker, and, when fasteners 30 are used, only requires a simple screwdriver.

In general, the materials used for the major components of system 2 are low-smoke zero halogen and suitable for high humidity high and low temperature environments. Visible features have a matte finish.

Housing 12 carries the light engine 40, the power supply 42 for light engine 40, and a battery backup system 44 for light engine 40. Locating battery backup system 44 within housing 12 provides system 2 with an advantage over the existing lights that remotely locate the battery backup components. Light engine 40 includes a plurality of light emitting diode (LED) light sources that are configured to last about five years making replacement of the entire housing 12 including the replacement of battery backup system 44 reasonable. Battery backup system 44 is designed to supply power to light engine 40 for four hours. System 44 automatic switches to emergency mode when power fails and returns to charge mode when power returns. System 44 thus includes batteries, a battery charger, and a transfer switch. System 44 also performs automatic self testing wherein system 44 simulates AC power failure, conducts a discharge test to monitor battery voltage and discharge current and, when the test is complete, returns to charge mode. This test performed for 30 sec each month, and four hours each year. The results of the tests can be stored locally or delivered to a remote location through a wired connection or through a wireless communications protocol. Each unit 10 can have its own unique identifier associated with the location of light unit 10. System 44 thus includes a battery self check circuit and a communications module that sends data generated from the self check circuit.

System 44 can include an indicator light 46 that can be an LED indicator which provides a solid signal indicator while line voltage (such as 120 VAC, 277 VAC, or other) is present, turns off is off during power outage, and blinks if automatic testing detects failure. Light 46 is shielded by a shield 48 to prevent train operators from seeing indicator light 46. In subway tunnel applications, indicator light 46 is not intended to be viewed from a moving train. When used, light 46 is viewed by maintenance workers walking the tracks. In these applications, system 44 can turn off the entire light unit when the self-test operation detects a failure in the battery system. A light unit that is completely off is readily noticed by a train driver and a service call can be arranged. A switch is provided that cuts power to the light engine when the self check circuit identifies a problem with the batteries. This switch or another switch can be configured to prevent battery backup system 44 from powering the lights when the unit is not installed. This allows the units to be stored within housing 12 in a condition ready for use without discharging batteries.

Figure 7:
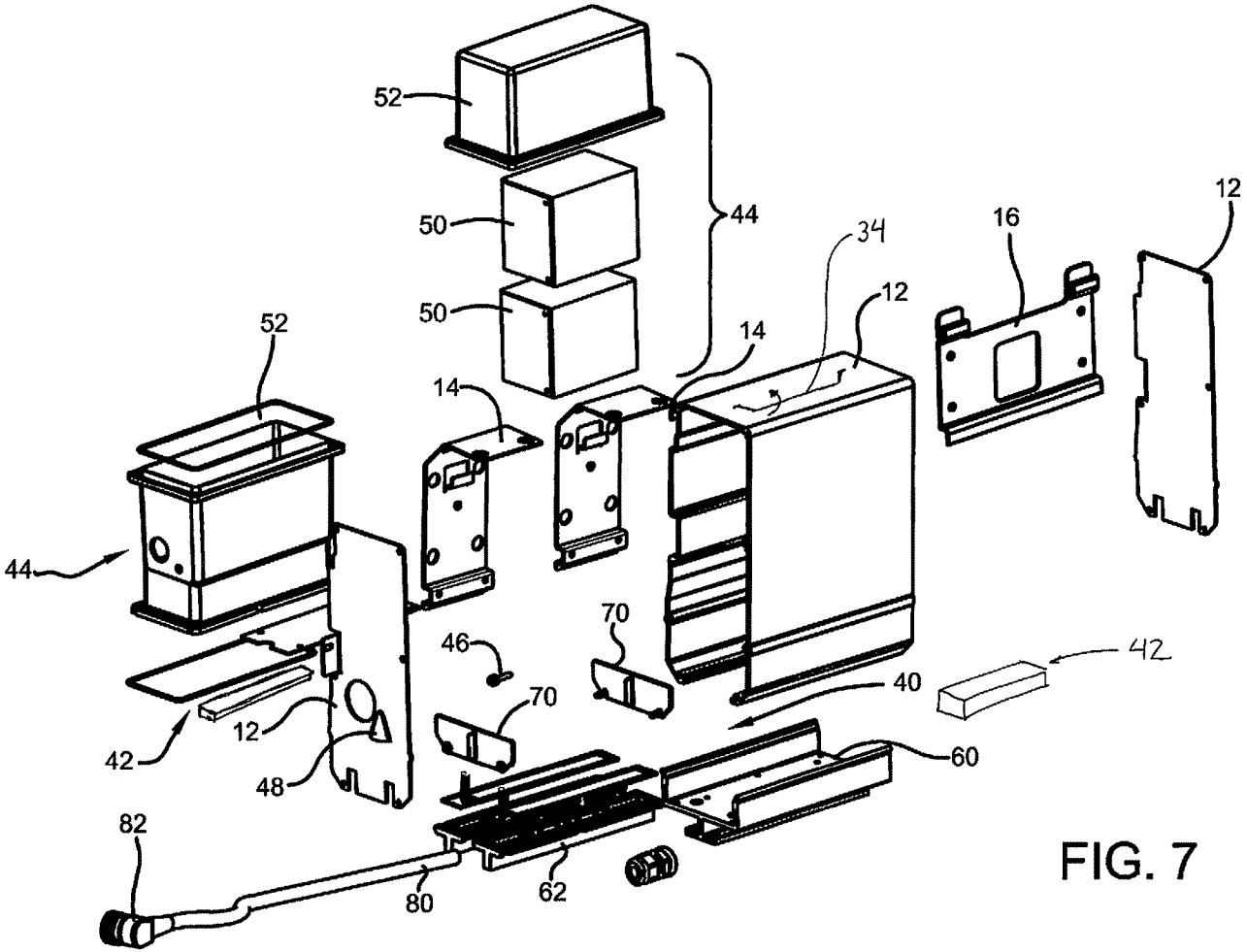
FIG. 7 is an exploded view of the system components.
Figure 8:
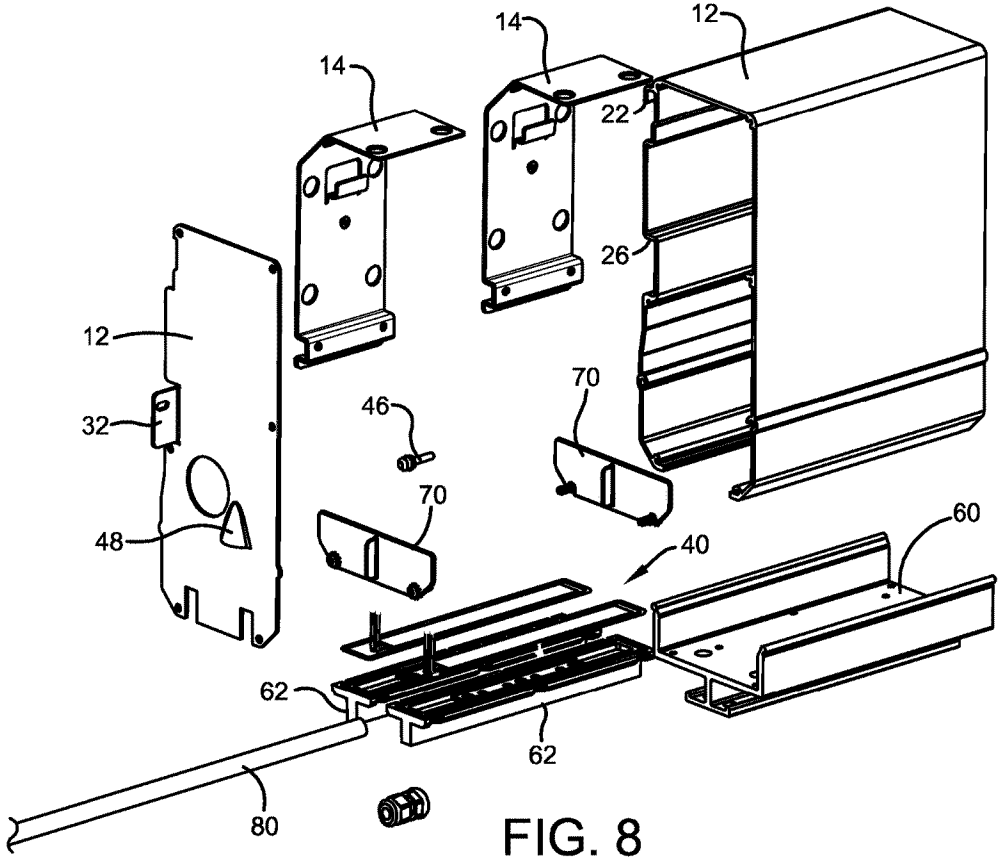
FIG. 8 is an enlarged exploded perspective view of the brackets, the housing, and light engine.
Figure 9:
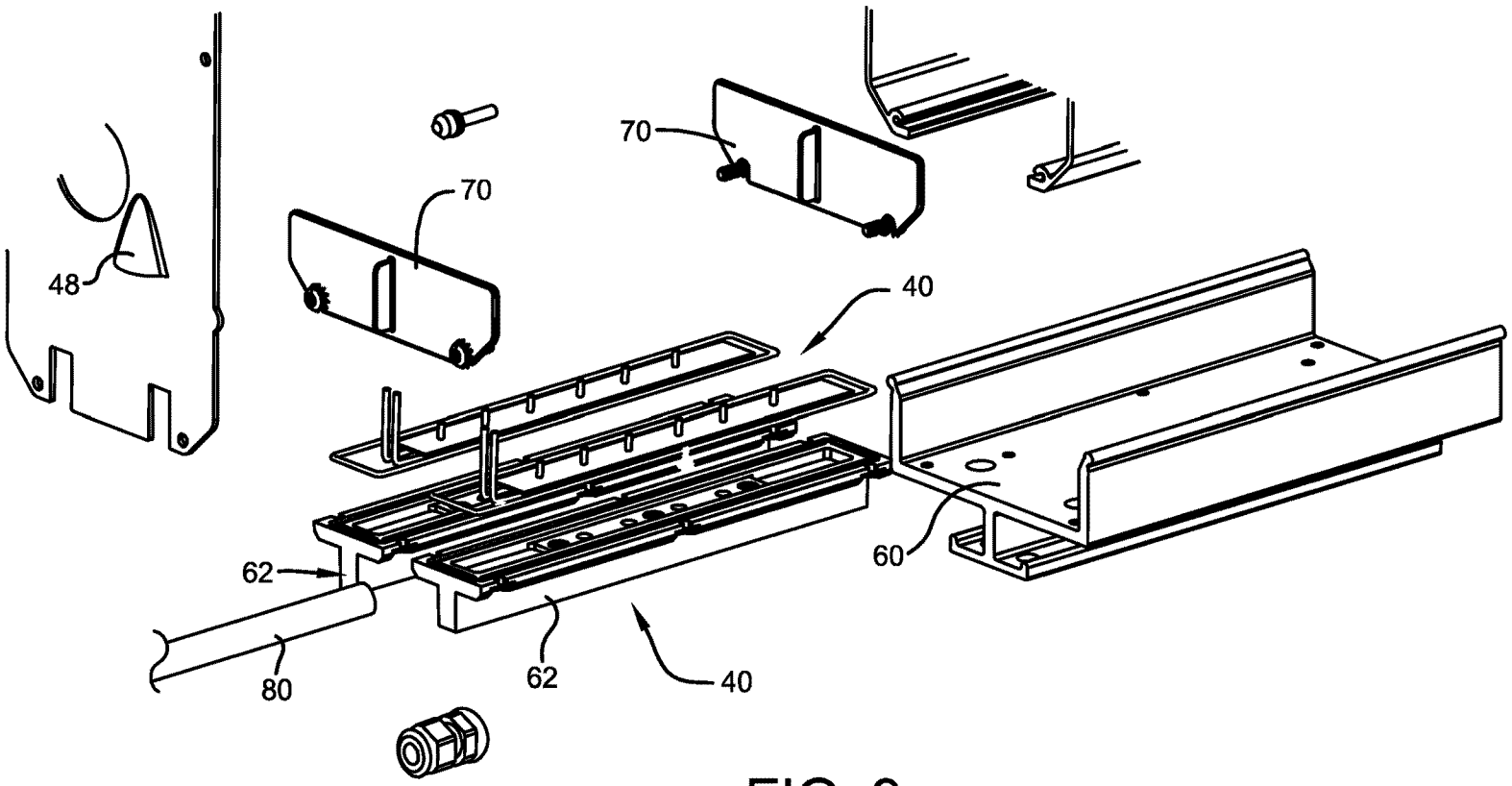
FIG. 9 is an enlarged exploded perspective view of the light engine.

Power supply 42 operates with an operating input voltage of 277 VAC±10% @ 60 Hz. Other power input voltages are possible. Power supply 42 outputs a low voltage direct current to light engines 40 suitable for the LED light engines. Power supply 42 or the input line voltage supplies the power needed to charge the batteries of system 44 and to run the self check features of battery system 44. Power supply 42 is disposed under the batteries and above light engine 40. Batteries 50 are disposed in a container 52 disposed within housing 12. Power supply 42 can be disposed above or within a top portion of a heat sink 60 which carries light engine 40 on its lower surface. FIG. 7 depicts alternate positions. Heat sink 60 is connected to the bottom of housing 12 using the channels defined by the interior of the front and rear walls of the enclosure. The lenses are disposed between the bottom of the heat sink 60 and the lower ends of the front and rear walls of the enclosure. Various seals and O-rings are used to seal the elements of system 2. The expected environmental conditions include relative humidity up to 100%; ambient temperature: −40° to 50° C.; steel dust in the air; significant vibration; and 24/7 operation.

Light engine 40 includes two rows of LED boards or strips disposed above lenses 62 designed to direct light downwardly from housing 12 onto the track bed. Optical Requirements: End of life—0.25 foot candles across tunnel floor (14 foot width, 6 to fourteen foot mounting height, 30 to 40 foot spacing on each side of tunnel with 15 to 20 foot stagger)—0.55 lumen maintenance factor; Reflectivity of all surfaces=0.1; Color temperature: 4000K max; CRI: 70 min. Light engine 40 is configured to at least match the light currently provided by the existing incandescent light bulbs if housing 12 are spaced the same. In one configuration, the light provided on the ground of the tunnel application is uniform both across and along the track and has no more than a 7:1 ratio between the maximum lit areas and the minimum lit areas.

Some light is directed through the ends of lenses 62. This light cannot shine in the direction of an oncoming train so housing 12 includes removable shades 70 that, when connected to housing 12, cover the ends of lenses 62. The selective use of shades 70 allows each enclosure to be configured in four different configurations—both ends covered, both ends uncovered, only left end covered, and only right end covered. Also, shades may be transparent and colored to provide indication of location within a tunnel. For example, shade 70 can be a blue plastic that indicates a telephone location or an emergency exit location.

Power is provided through a power supply cord 80 that has a quick connect and quick disconnect connector 82. Connector 82 is used with a junction box having the line voltage and a corresponding connector. The insulation on the power supply cord is a low smoke zero halogen (LSZH) material. In another configuration, power supply cord 80 extends from the junction box with connector 82 disposed at the end of the cord that is connected to housing 12. Housing 12 supports the corresponding connector to allow power to be readily connected after the unit is replaced. This configuration allows unit 10 to be replaced without replacing power supply cord 80.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. An LED light fixture for providing pathway light for a train tunnel; the LED light fixture mountable to a surface to provide downwardly-directed light for the train track of a train tunnel; the LED light fixture comprising:

an LED light engine;

a battery backup system that includes a backup battery;

an LED power supply outputting a low voltage direct current for powering the LED light engine;

a self-test system that periodically tests the backup battery system; the self-test system including a wireless communication module that reports self-test data;

a light unit housing that carries the LED light engine, the LED power supply, and the battery backup system; the light unit housing having a bottom and carrying the LED light engine within the light unit housing in a position to shine light down from the bottom of the light unit housing when the LED light fixture is mounted to the surface to provide track bed lighting; and further comprising a bracket for mounting the light unit housing to the surface; and a spacer disposed between the light unit housing and the bracket to prevent direct contact between the housing and the bracket to limit galvanic corrosion.

2. The light fixture of claim 1, wherein the bracket is stainless steel, the light unit housing is aluminum, and the spacer is one of a nonmetal material and a coated metal material.

3. The light fixture of claim 1 wherein the light unit housing is gravity mounted on the bracket.

4. The light fixture of claim 3, wherein the light unit housing includes a hook that slides into engagement with a hook defined by the bracket to support the light unit housing from the bracket.

5. The light fixture of claim 3, wherein the bracket defines a shelf and the light unit housing defines a ledge that rests on the shelf when the light unit housing is connected to the bracket.

6. An LED light fixture for providing pathway light for a train tunnel; the LED light fixture mountable to a surface to provide downwardly-directed light for the train track of a train tunnel; the LED light fixture comprising:

an LED light engine;

a battery backup system that includes a backup battery;

an LED power supply outputting a low voltage direct current for powering the LED light engine;

a self-test system that periodically tests the backup battery system; the self-test system including a wireless communication module that reports self-test data;

a light unit housing that carries the LED light engine, the LED power supply, the self-test system, the wireless communication module, and the battery backup system; the light unit housing having a bottom and carrying the LED light engine within the light unit housing in a position to shine light down from the bottom of the light unit housing when the LED light fixture is mounted to the surface to provide track bed lighting; and further comprising a bracket for mounting the light unit housing to the surface; and a spacer disposed between the light unit housing and the bracket to prevent direct contact between the light unit housing and the bracket to limit galvanic corrosion.

7. The light fixture of claim 6, wherein the bracket is stainless steel, the light unit housing is aluminum, and the spacer is one of a nonmetal material and a coated metal material.

8. The light fixture of claim 6, wherein the light unit housing is gravity mounted on the bracket.

9. The light fixture of claim 6, wherein the combined light unit housing, LED light engine, and battery backup system all fit within a perimeter having a height of 11.5 inches and a width of 4.5 inches.

10. The light fixture of claim 9, wherein the perimeter has a length of 12 inches.

11. The light fixture of claim 6, further comprising a quick connect power connector that allows the light fixture to be readily replaced.

* * * * *